United States Patent [19]

Block

[11] Patent Number: 4,872,292

[45] Date of Patent: Oct. 10, 1989

[54] FLAP WHEEL

[76] Inventor: Aleck Block, 800 Warner Ave., Los Angeles, Calif. 90024

[21] Appl. No.: 210,006

[22] Filed: Jun. 22, 1988

[51] Int. Cl.[4] ..... B24B 9/02

[52] U.S. Cl. ..... 51/334; 51/401; 51/402; 51/407; 51/336

[58] Field of Search ..... 51/330, 331, 332, 334, 51/336, 337, 394, 395, 401, 402, 407

[56] References Cited

U.S. PATENT DOCUMENTS

| | | | |
|---|---|---|---|
| 2,755,608 | 7/1956 | Peterson | 51/395 |
| 3,053,021 | 9/1962 | Polock | 51/337 |
| 4,055,919 | 11/1977 | Belanger | 51/334 |

*Primary Examiner*—Frederick R. Schmidt
*Assistant Examiner*—Maurina Rachuba
*Attorney, Agent, or Firm*—Ellsworth R. Roston; Charles H. Schwartz

[57] ABSTRACT

Abrasive particles are adhered on a first surface of a backing member to define a flap. These particles are removed from support portions of a plurality of flaps. The flaps are stacked and compressed so that the inner ends of the support surfaces on contiguous flaps abut and so that the abrasive particles at the juncture between the support portion and a working portion on each flap abut the second surface of the contiguous flap. This causes a controlled spacing (e.g. wedge-shaped) to be produced between the support portions of contiguous flaps with the flaps uniformly separated at their outer ends. These controlled spacings may be at least partially filled with an adhesive compatible with the adhesive on the first flap surfaces to form the flaps into an array or pack. An anchor may be attached to the pack and may be constructed to couple the pack to a rotary member. The anchor may have an arm attached to the flap support portions with an enlarged portion at its inner end for coupling to the rotary member. Alternatively, the anchor may have a pair of spaced arms attached to the flap support portions and a portion integrating the arms and coupled to the rotary member or may be attached to the inner ends of the support portions be disposed in a socket with a restricted neck in the rotary member. Alternatively, the flaps may be packed tightly into an annulus to define a central hole, potted with an adhesive.

52 Claims, 3 Drawing Sheets

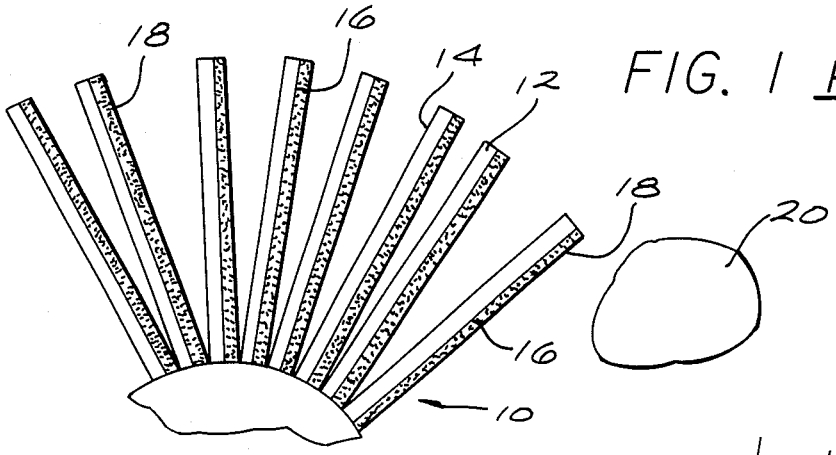
FIG. 1 PRIOR ART
FIG. 2
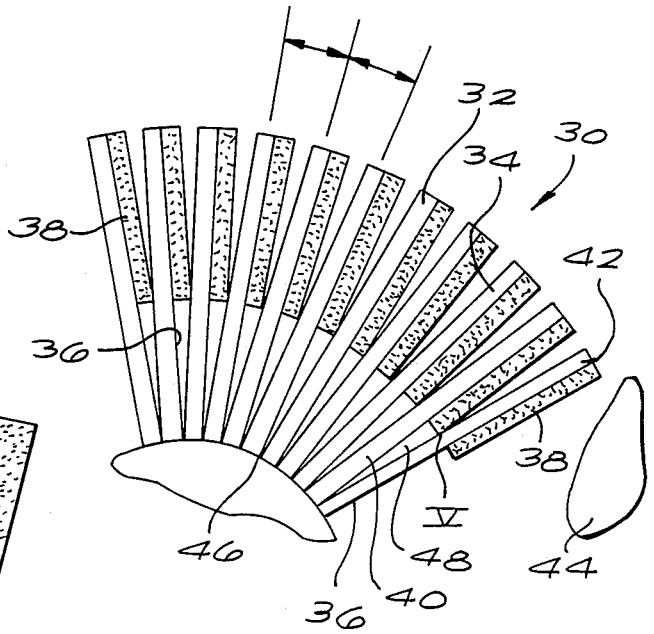
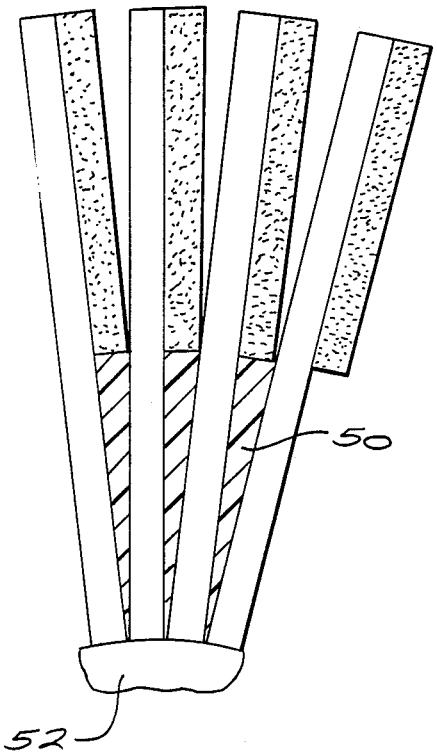
FIG. 3
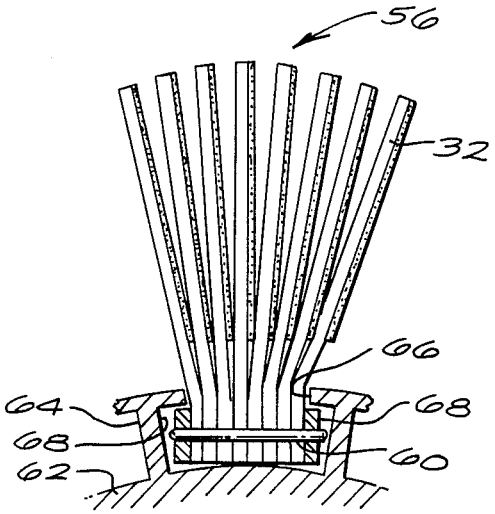
FIG. 4

FIG. 9
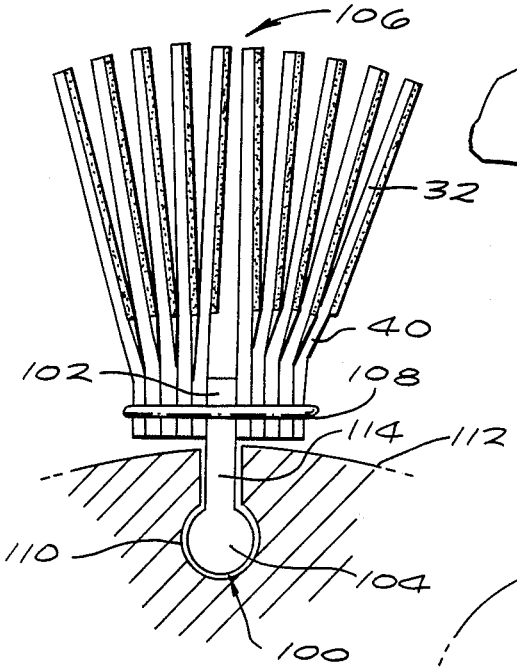
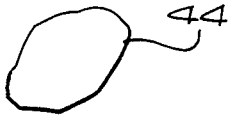
FIG. 10
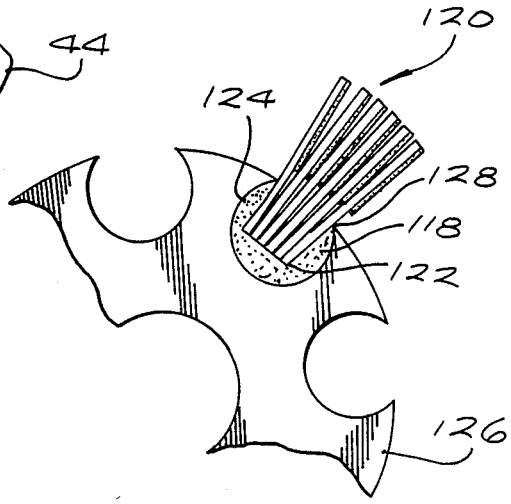
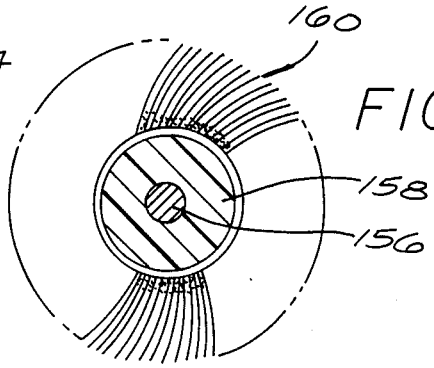
FIG. 11
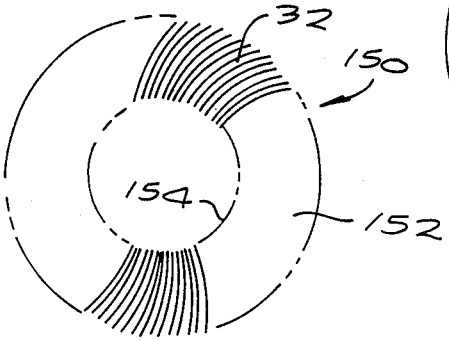
FIG. 12
FIG. 13
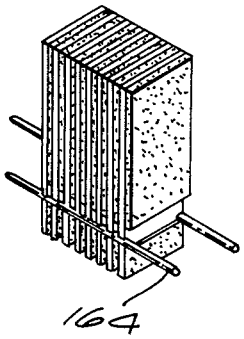
FIG. 15
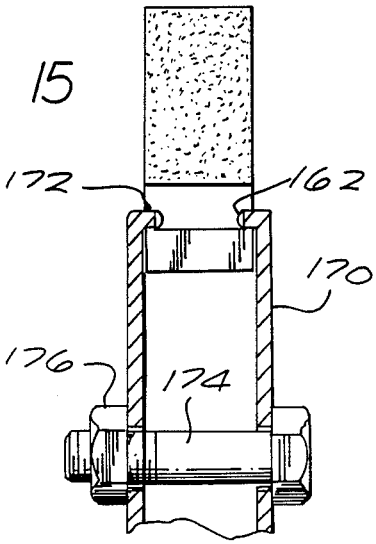
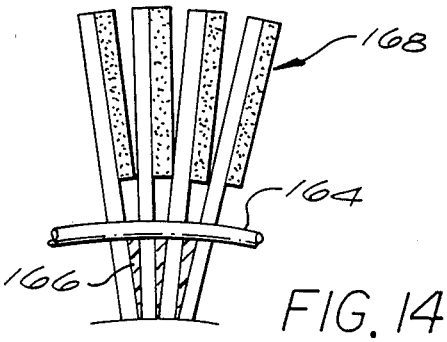
FIG. 14

FLAP WHEEL

This invention relates to abrasive wheels. The invention particularly relates to abrasive flap wheels in which a considerably increased number of abrasive flaps can be provided in wheels of any particular size than in the prior art and in which a more uniform abrasive action can be provided on a workpiece than in abrasive wheels of the prior art.

Abrasive flap wheels are used to provide a resilient, but positive, abrading action on a workpiece. The abrasive wheels are formed from a plurality of abrasive flaps each including a backing member and abrasive particles adhered to the backing member. The flaps are generally disposed in an annular array to form a wheel which is supported by rotary members such as plates. The plates are rotated to obtain a rotation of the flaps past a workpiece. As the individual flaps move past the workpiece, the flaps in the array impinge on the workpiece and provide an abrading action on the workpiece. Alternatively, the wheel may be formed from a plurality of packs or arrays.

The abrasive flap wheels now in use have certain significant disadvantages. One disadvantage is that the wheels can contain only a relatively limited number of flaps. This results in a correspondingly limited rate of stock removal from the workpiece during the wheel operation, and it also results in relatively limited life of the wheel. Another disadvantage is that the flaps in the wheels are not always evenly spaced from one another, resulting in a non-uniform wear on the tips of the flaps, and creating an imbalance in the wheels and a tendency to produce an uneven finish on the workpiece. Another disadvantage is that, when the flaps are worn down to short lengths, they lose much of their flexibility. This sharply reduces the wheel's abrading ability because it is the function of the flaps to bend back as they contact the work surface and thus expose abrasive grains at the tip margins of the flaps to the workpiece.

A considerable effort has been made in the past, and significant amounts of money have been expended, to provide an abrasive wheel which overcomes the above difficulties. In spite of such efforts and such expenditures of money, the problems discussed above still persist. These problems have been aggravated because a substantial amount of time has to be expended in removing the worn abrasive wheel from a chuck and in inserting the new abrasive wheel on the chuck.

This invention relates to apparatus for overcoming the above problems. The invention provides a wheel in which the number of flaps, for a wheel of any particular diameter, is increased by a factor as high as seventy-five percent (75%) above the number of flaps now in use in wheels of the same particular diameter. Such wheels are further advantageous in that the flaps are substantially uniformly spaced around the periphery of the wheel. This provides for a more uniform abrading action on a workpiece by the wheels of this invention than by the wheels of the prior art.

In one embodiment of the invention, abrasive particles are adhered to an adhesive on a first surface of a backing member to define a flap. These particles are removed from support portions of a plurality of flaps. The flaps are then stacked and the stack is compressed and preferably formed into an arcuate array so that the inner ends of the support surfaces on contiguous flaps abut and so that the abrasive particles at the juncture between the support portion and a working portion on each flap abut the second surface of the contiguous flap. This causes a controlled spacing (e.g. wedge-shaped) to be produced between the support portions of contiguous flaps and the flaps to be substantially uniformly separated at their outer ends. These controlled spacings are at least partially filled with an adhesive compatible with the adhesive on the first flap surfaces to form the flaps into a pack or array.

In another embodiment, the flaps may be stacked to form a pack of a certain relatively limited number of flaps, with a certain number of packs being arranged on a central rotary member to form a wheel. An anchor may be attached to each pack and may be constructed to couple the pack to the rotary member. The anchor may have an arm attached to the flap support portions and, at its inner end, may have an enlarged portion for coupling to the rotary member. Alternatively, the anchor may have a pair of spaced arms attached to the flap support portions and also a portion integrating the arms and coupled to the rotary member. As another alternative, the anchor may be attached to the inner ends of the support portions and may be disposed in a socket with a restricted neck in the rotary member.

As a further alternative, the flaps may be compressed and arranged in an annular array to form a wheel with a central hole. For example, the flaps may be stacked in an annular form defining a central hole. This hole and the support surfaces may be potted with an adhesive with a mandrel embedded in the center and extending axially for attachment to a power tool. Alternately, the stack may be potted with a hole for an arbor.

FIG. 1 is a fragmentary schematic perspective view of a segmental annular array or pack of abrasive flaps of the prior art;

FIG. 2 is a fragmentary schematic view, similar to that of FIG. 1, of a segmental annular array or pack of abrasive flaps constituting one embodiment of the invention;

FIG. 3 is an enlarged fragmentary schematic view, similar to that shown in FIGS. 1 and 2, of a portion of the annular array or pack shown in FIG. 2;

FIG. 4 is a fragmentary schematic view, similar to that shown in the previous Figures, of one embodiment of a wheel which incorporates abrasive packs or arrays, such as shown in FIGS. 2 and 3, mounted individually in an annular array on a hub structure;

FIGS. 7, 8 and 9 are fragmentary schematic views, similar to that shown in the previous Figures, of fourth, fifth and sixth embodiments of a wheel which incorporates abrasive packs or arrays such as shown in FIGS. 2 and 3;

FIG. 10 is a schematic fragmentary perspective view, similar to that shown in FIGS. 4–9 of an abrasive wheel constituting a seventh embodiment of the invention and incorporating abrasive packs or arrays such as shown in FIGS. 2 and 3;

FIG. 11 is a schematic end elevational view of an abrasive wheel constituting an eighth embodiment of the invention;

FIG. 12 is a schematic end elevational view of the abrasive wheel of FIG. 11 at an intermediate stage in the manufacture of the wheel;

FIG. 13 is a schematic perspective view of a plurality of flaps constituting a pack or array at an intermediate stage in the manufacture of the pack, the method of manufacture being somewhat different that in the previous embodiments;

Figure 5:
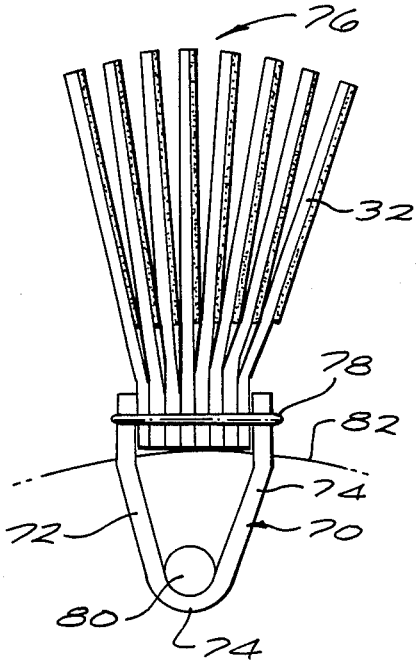
FIG. 5 is a fragmentary schematic view, similar to that shown in the previous Figures, of a second embodiment of a wheel which incorporates abrasive packs or arrays such as shown in FIGS. 2 and 3.

FIG. 14 is a view in the flaps in the pack of FIG. 14 after the flaps have been compressed into a segmental annular pack or array by drawing strings disposed in grooves at th sides of the flaps and after adhesive has been disposed in at least a portion of the space between adjacent flaps at the support portions of the flaps; and FIG. 15 is an end elevational view of a wheel incorporating the pack or array of abrasive flaps shown in FIGS. 13 and 14.

FIG. 1 illustrates on a fragmentary, schematic basis a portion of an abrasive array or pack, generally indicated at 10, of the prior art. The abrasive array or pack 10 includes a plurality of abrasive flaps 12 each extending outwardly in a generally radial direction. Each of the flaps 12 is formed from a backing member 14 made from a suitable material such as a cloth. Each of the flaps 12 is provided with a layer of an adhesive 16 on a first surface of the backing member. The adhesive may be any suitable material such as an epoxy. Abrasive particles 18 are adhered to the adhesive. When the flaps 12 are assembled to form the abrasive pack 10, the abrasive particles on the first surface of each abrasive flap 12 are contiguous to the second surface of the contiguous flap. The flaps 12 are preferably disposed in a segmental annular array in the pack 10.

The abrasive wheels of the prior art such as the wheel 10 have certain inherent disadvantages. One disadvantage is that the number of flaps capable of being disposed in a pack of any particular width is somewhat limited. This limits the abrading action of the pack 10 on a workpiece 20 when the pack is disposed on an abrasive wheel. It also limits the life of the pack 10 when disposed on the wheel. Since the time for setting up the wheel to engage the workpiece is a significant factor in determining the cost of buying and using the wheel, the limited life of the wheel is a deterrent to using the wheel for abrading the workpiece in comparison to other apparatus and techniques for abrading the workpiece.

Another disadvantage of a wheel formed from an annular array of abrasive flaps such as the sector 10 is that the abrading action of the flaps 12 on the workpiece 20 is not uniform as the successive flaps rotate past the workpiece. This results from the fact that the flaps 12 are not uniformly spaced around the periphery of the abrasive wheel. As will be appreciated, the force exerted on the workpiece 20 by the impingement of the flaps 12 on the workpiece can vary depending upon the space between each flap and the previous flap in the wheel. A further disadvantage is that the resiliency of the flaps impinging on the workpiece becomes reduced as the flaps become worn. This is particularly true when the adhesive is disposed along a substantial portion of the radial length of the flaps.

FIG. 2 illustrates on a magnified, fragmentary, schematic basis an array or pack generally indicated at 30, of this invention. The pack 30 includes a plurality of abrasive flaps 32 each formed from a backing member 34 constructed in a manner similar to the backing member 14 of the prior art. An adhesive 36 such as an epoxy is applied to a first surface of each backing member 34 in a manner similar to that of the prior art, and abrasive particles 38 are adhered to the adhesive 36 in a manner similar to that of the prior art.

Each of the flaps 32 may be considered to have a support portion 40 and a working portion 42. The support portion 40 of each flap 32 may be considered to constitute that portion in which the flaps are attached to a wheel or to be so close to the wheel as not to impinge on the workpiece. The working portion 42 may be considered to constitute that portion which is capable of engaging a workpiece 44 to provide an abrasive action on the workpiece. In the embodiment of this invention, the abrasive particles 38 are removed from the support portion 40 of each abrasive flap 32.

In removing the abrasive particles 38 from the support portion 40 of each flap 32, should preferably be taken that the backing member 14 on the flap is not weakened. In this way, the flaps 32 will be retained in the wheel 30 without tearing from the wheel even when great centrifugal forces are exerted by the workpiece 44 on the flaps. Preferably in most embodiments, a portion of the adhesive 36 may be retained on each backing member 34 when the abrasive particles 38 are removed from the backing member. It will be appreciated, however, that all of the adhesive 32 may be removed from the support surface 40 of each flap 32.

After the abrasive particles 38 have been removed from the support portion 40 of each backing member 34, the backing members are stacked to form the pack 30. In such stack, the abrasive particles on the first surface of each flap face the second surface of the contiguous flap. The support surfaces 40 of the flaps 32 at the inner ends of the working portion are then tightly compressed to minimize the space occupied by the flaps. By reason of the reduced thickness of the flaps 32 at the support portions 40, the number of flaps in a given space such as a sector can be increased by as much as seventy-five percent (75%) in comparison to the number of flaps occupying such space in the prior art. The percentage of increase is dependent upon the coarseness of the grit in the abrasive particles 38. As a general rule, the percentage of increase in the numbers of flaps increases with increases in the coarseness of the grit.

When the flaps 32 are compressed at the support portions 40, the inner ends of the support portions on contiguous flaps abut one another. This is indicated at 46 in FIG. 2. Furthermore, the abrasive particles 38 on each flap 32 at the juncture between the support portion 40 and the working portion of that flap engage the second surface of the contiguous flap. This causes a controlled spacing 48 to be produced between such contiguous flaps. This spacing may be wedge-shaped. Because of this controlled spacing, each flap extends outwardly in a substantially radial direction. This causes the outer end of the working portion 42 of each flap 32 to be spaced uniformly from the outer end of the working portion of the contiguous flaps.

To retain the flaps 32 in a fixed relationship relative to one another as defined in the previous paragraph, an adhesive 50 is disposed in at least a portion of the controlled space 48 between each pair of flaps. The adhesive 50 is compatible with the adhesive 36 and with the material of the backing members 34 so as to bond the backing members together. Preferably the adhesive 50 is an epoxy. This adhesive may also be disposed at the inner ends of the support portions 40 of the flaps 32, as indicated at 52 in FIG. 3, so as to enhance the bond between the different abrasive flaps in the pack. The adhesive 50 functions to fill the controlled spacing 48 and to bond the adjacent flaps 32. By disposing the adhesive in the controlled spacings 48 only partially along the radial lengths of the flaps 32, the resiliency of the flaps in impinging on the workpiece is enhanced and the ability of the flaps to be used after being reduced in length by wear is facilitated.

FIG. 4 illustrates one embodiment in which the features of this invention may be incorporated. In the embodiment shown in FIG. 4, the flaps 32 are disposed in packs generally indicated at 56. Pads 58 are disposed at the opposite ends of each pack 56 so that a fastener 60 can be inserted through the pads and the support portions 40 of the flaps without damaging the flaps. The fastener 60 may constitute a staple or staples.

The packs 56 are adapted to be supported by a rotary member 62 for rotation with the rotary member. The support is provided by a railing 64 integral with the rotary member 62 at the annular periphery of the rotary member. The railings 64 define restricted openings 66 at their radially outer end to confine the support portions 40 of the flaps 32 within compartments 68 defined by the flaps.

FIG. 5 illustrates another embodiment in which the features of this invention may be incorporated. Except for the construction of the packs of abrasive flaps, this embodiment may be similar to that disclosed in U.S. Pat. No. 3,820,291 issued to James A. Belanger on June 28, 1974. In this embodiment, a coupling member generally indicated at 70 is provided with a pair of spaced arms 72 and a portion 74 integrating the arms. The arms 72 are disposed at the opposite ends of the abrasive flaps 32 in a pack generally indicated at 76. A fastener 78 is inserted through the arms 74 and through the support portions 70 of the flaps 32. The integrating portions 74 of the coupling members 70 are then disposed on pins 80 in a rotary member 82 to retain the packs 76 in fixed position on the rotary member as the rotary member rotates.

Figure 7:
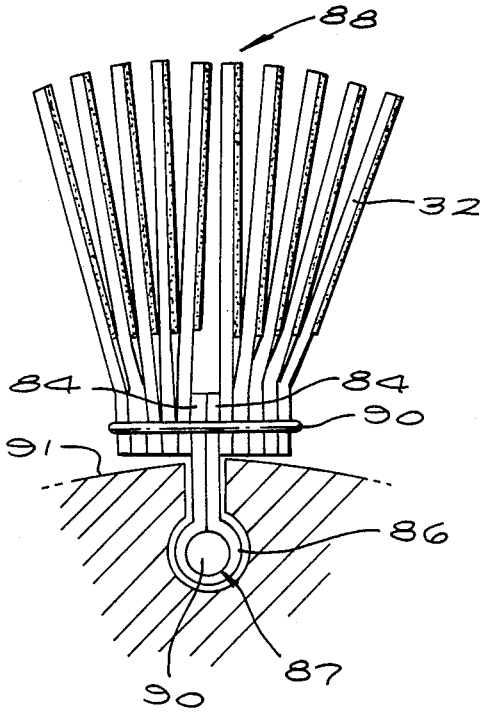

FIG. 7 illustrates another embodiment utilizing a coupling member to attach the packs of abrasive flaps of this invention to a rotary member. In the embodiment shown in FIG. 7, a coupling member generally indicated at 83 is defined by a pair of arms 84 in contiguous relationship to each other and by a portion 86 having a hollow bulbous configuration and integrating the arms. The arms 84 are disposed between a pair of the abrasive flaps 32 in a pack generally indicated at 88. The support portions of the flaps 32 and the arms 84 are connected by a fastener 90, which may be a staple or staples. The coupling member 83 is coupled to a rotary member 91 by providing a pin 92 on the rotary member and by passing the pin through the bulbous integrating portion 86 of the coupling member The bulbous integrating portion 86 may be disposed in a socket 94 in the rotary member 91. The embodiment shown in FIG. 7 may be similar to that disclosed in U.S. Pat. No. 3,685,217 issued to James A. Belanger on Aug. 22, 1972.

FIG. 9 illustrates a further embodiment utilizing a coupling member to attach the packs of abrasive flaps of this invention to a rotary member. The coupling member is generally indicated at 100 in FIG. 9 and is provided with an arm 102 and a solid bulbous portion 104. The arm 102 is disposed between the support portions 40 of a pair of flaps 32 in a pack generally indicated at 106. The flaps 32 in the pack 106 are fastened by a fastener 108 such as a staple. The bulbous portion 104 is disposed in a socket 110 in a rotary member 112. The socket 110 is provided with a restricted opening 114 at its outer end to retain the bulbous portion 104 in the socket. The embodiment shown in FIG. 9 and described above is similar to that disclosed in U.S. Pat. No. 3,648,417 issued to me on Mar. 14, 1972, for a "Rotary Abrasive Device". It is advantageous in that the arm 102 can flex when the flaps 32 in the pack 106 can flex when the abrasive flaps 32 in such pack impinge on the workpiece 44.

FIG. 10 illustrates another embodiment for supporting packs of the abrasive flaps 32 on a rotary member. In the embodiment shown in FIG. 5, adhesive 118 is not only disposed in the controlled spaces between contiguous flaps in a pack generally indicated at 120 but is formed at the inner ends of the flaps to define a bulbous portion 122. This bulbous portion 122 is disposed in a socket 124 of a rotary member 126. The socket 124 is disposed at the periphery of the rotary member 126 and is provided with a restricted opening 128. Since there are no abrasive particles on the flaps 32 at the position of the restricted opening 128 because the abrasive particles have been removed from the support portions 40, it is easier to slide the pack 118 into the socket 122 than the corresponding packs of the prior art.

Figure 6:
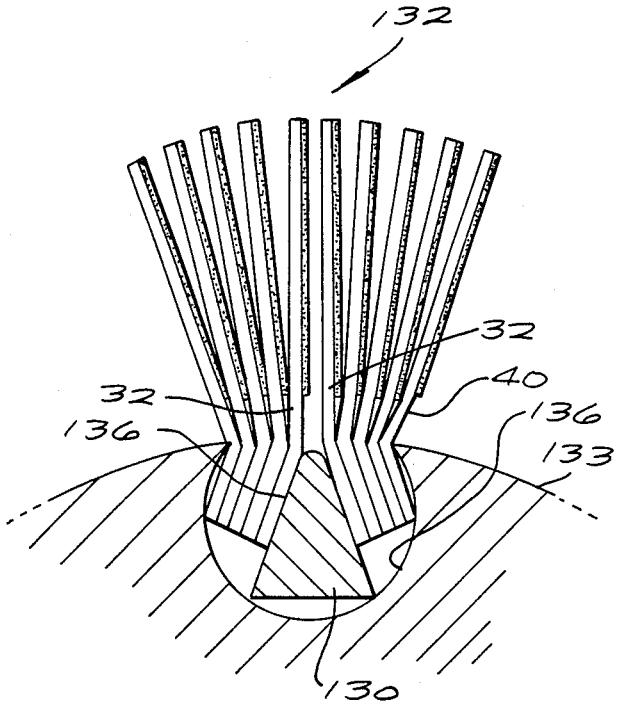
FIG. 6 is a fragmentary schematic view, similar to that shown in the previous Figures, of a third embodiment of a wheel which incorporates abrasive packs or arrays such as shown in FIGS. 2 and 3.

FIG. 6 illustrates an additional embodiment for supporting packs of the abrasive flaps 32 on a rotary member. In the embodiment shown in FIG. 8, a detaining member 130 is disposed between the support surfaces 40 of a pair of flaps 32 in a pack generally indicated at 132. The detaining member 130 is preferably wedge-shaped and is preferably attached as by adhesive 134 to the contiguous flaps. This causes the support portions of the flaps to be retained in a socket 136 of a rotary member 138. The flaps are prevented from leaving the socket 136 by providing the socket with a restricted opening 140. Alternatively, the flaps may be formed into two (2) separate sub-packs and the detaining member 130 may be forced into the socket 138 between the sub-packs after the sub-packs have been inserted into the socket.

Figure 8:
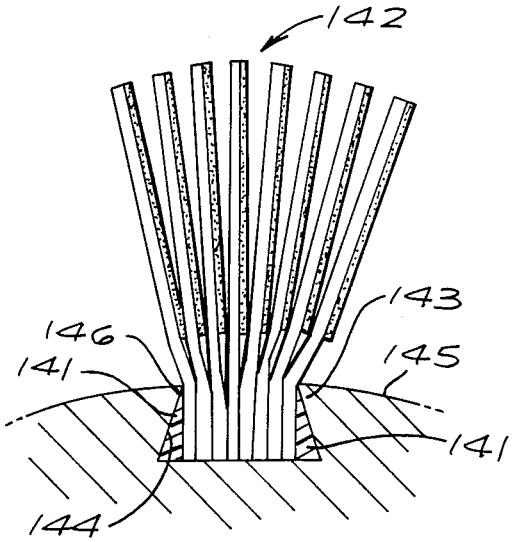

FIG. 8 illustrates an embodiment similar in some respects to the embodiment shown in FIG. 8. In the embodiment shown in FIG. 8, a pair of detaining members 141 are disposed at the opposite ends of the flaps 32 in a pack generally indicated at 142. The detaining members 141 are preferably wedge-shaped. The detaining members 141 may be adhered as by adhesive 143 to the support portions of the flaps 32 at the ends of the pack 142 and the resultant pack may be inserted in a socket 144 at the periphery of a rotary member 145. The socket 144 may be provided with a restricted opening 146. Alternatively, the detaining members 141 may be forced into the socket 144 after the pack 142 has been inserted into the socket.

FIGS. 11 and 12 illustrate another embodiment of the invention. In this embodiment, a plurality of the flaps 32 are disposed in an annular form generally indicated at 150 and having an annular periphery 152. By providing the form 150, the flaps 32 can be stuffed into the form to such an extent that the flaps are effectively compressed against one another. As will be appreciated, the number of the flaps 32 capable of being stuffed into the form 150 is considerably increased relative to the prior art because the abrasive particles have been stripped from the support portions 40 of the flaps. The flaps 32 are disposed in the form 150 to define a central opening 154.

A mandrel 156 is extended through the center of the hole 154 and adhesive 158 is disposed in the central opening 154 and in at least a portion of the support portions of the flaps 32. In this way, an annular wheel generally indicated at 160 is produced. Alternatively, the central opening 154 is only partially filled with the adhesive 158 so that a central hole is provided to receive a mandrel.

FIGS. 13, 14 and 15 illustrate another embodiment of the invention. In this embodiment, the flaps 32 are provided with grooves 162 at their opposite sides in the support portions 40 of the flaps. Strings 164 may be extended through the aligned grooves 162 in the flaps 32. When the strings are tightened, the flaps 32 may be compressed against one another to provide the controlled spaces 48 between the flaps. Adhesive 166 may then be disposed in the controlled spaces 48, preferably only to a radial distance below the grooves 162. In this way, packs or arrays generally indicated at 168 may be formed in segments of an annular array.

The packs 168 may be retained by plates 170 having flanges 172 which extend into the grooves 162. The plates 170 may be retained against the packs 168 by a mandrel 174 and a nut 176. In this way, the grooves 162 serve two (2) purposes. They provide for the reception of the strings 164 and for the tightening of the strings to form the pack 168 with the compressed flaps 162. They also provide for the retention of the packs 168 by the plates 170.

The disposition of the adhesive 166 at a position radially below the grooves 162 offers certain important advantages. One advantage is that the resiliency of the flaps 32 in the packs 168 is enhanced. Another advantage is that the life of the packs 168 is increased because the flaps in the packs can be worn to a greater radial depth before they have to be discarded.

The apparatus described above has certain important advantages. It provides for a significantly higher number of flaps in a pack than in the prior art. For example, for flaps with coarse grains, the number of flaps may be increased by more than seventy five percent (75%) in a pack or array of a particular thickness in comparison to the number of flaps that can be provided with such coarse grains in a pack or array of the particular thickness in the prior art. Furthermore, the abrasive flaps in the packs of this invention are substantially uniformly spaced at their outer ends in comparison to the positioning of the flaps in the packs of the prior art. These factors are important in enhancing the abrading action of the flaps in the packs of this invention in comparison to the flaps in the packs of the prior art and in significantly prolonging the useful life of the packs of this invention in comparison to the useful life of the packs of the prior art.

Although this invention has been disclosed and illustrated with reference to particular embodiments, the principles involved are susceptible for use in numerous other embodiments which will be apparent to persons skilled in the art. The invention is, therefore, to be limited only as indicated by the scope of the appended claims.

What is claimed is:

1. In combination for use in a pack for engaging a workpiece, a plurality of abrasive flaps each having first and second parallel surfaces and including a backing member and abrasive particles on the first surface of the backing member, each of the abrasive flaps having a working portion at its outer end and a support portion at its inner end, the flaps having no abrasive particles in the pack in all of the support portions of the flaps but retaining the abrasive particles in the working portions of the flaps, the abrasive flaps having a compressed relationship with respect to one another at an intermediate position in the support portions of the flaps in the direction between the inner and outer ends of the flaps, and an adhesive material disposed between the flaps at the support portions of the flaps to retain the flaps in the compressed relationship, the disposition of the abrasive material on the working portions of the flaps providing for a progressive spacing between the flaps with progressive distances from the inner ends of the flaps.

2. In a combination as set forth in claim 1 wherein the adhesive material adheres to the support portions of the flaps to provide for a radial disposition of the support portions of the flaps and a substantially uniform separation between the flaps at the ends of the working portions of the flaps.

3. In combination for use in an array for engaging a workpiece, a plurality of abrasive flaps each having first and second parallel surfaces and including a backing member and abrasive particles on the first surface of the backing member, each of the abrasive flaps having a working portion and a support portion, the abrasive particles being removed form the flaps in the packs at the support portions of the flaps, the abrasive flaps being compressed against one another at the support portions of the flaps, and an adhesive material disposed between the flaps at the support portions of the flaps, wherein the abrasive particles on each abrasive flap have been attached by an adherent material to the support portion of the flap and wherein at least a portion of the adherent material remains on the support portion of the flap after removal of the abrasive particles from the flap and wherein additional adherent material is provided between the flaps in the support portions of the flaps and is adhered to the adherent material remaining on the flaps after the removal of the abrasive particles from the flaps.

4. In combination for use in an array for engaging a workpiece, a plurality of abrasive flaps each having first and second parallel surfaces and including a backing member and abrasive particles on the first surface of the backing member, each of the abrasive flaps having a working portion and a support portion, the abrasive particles being removed from the flaps in the packs at the support portions of the flaps, the abrasive flaps being compressed against one another at the support portions of the flaps, and an adhesive material disposed between the flaps at the support portions of the flaps, wherein the disposition against the backing member of the adjacent flap of the abrasive particles at the juncture between the support portion and the working portion of each flap and the disposition of the ends of the support portions in continuous relationship to each other produce a controlled spacing between the adjacent flaps and wherein adhesive material fills the controlled spacing between the adjacent flaps.

5. In a combination as set forth in claim 4, retaining means attached to the flaps at the support portions of the flaps to facilitate the retention of the flaps in the packs in the contiguous relationship.

6. In combination for engaging a workpiece, a plurality of abrasive arrays each formed from a plurality of abrasive flaps, each of the abrasive flaps in each of the abrasive arrays including a backing member having first and second opposite surfaces and having a working piece portion at its outer end and a support portion at its inner end and having abrasive particles adhered to one of the opposite surfaces in the working portion and having no abrasive particles on such one of such surfaces in all of the support portion, the support portions of the abrasive flaps in each array having a tightly compressed and adhered relationship with respect to one another at an intermediate position on the support portions in the direction between the inner and outer ends of the flaps, and means for retaining the arrays in the plurality in an annular configuration, with the support portions of the flaps in each array in the compressed configuration, to define a wheel which is rotatable to move the working portions of progressive flaps in the successive packs against the workpiece, the disposition of the abrasive particles only on the working portions of the flap providing for a progressive spacing between the flaps in each array with progressive distances from the inner ends of the flaps.

7. In a combination as set forth in claim 6, means coupled to the retaining means for providing for a rotation of the arrays and the retaining means.

8. In a combination as set forth in claim 7, the retaining means including end plates and means for retaining the end plates against the flaps to retain the flaps in the annular relationship.

9. In a combination as set forth in claim 7, anchor means for each array, the anchor means constituting a member extending to the support portions of the flaps in the pack and attached to the support portions of such flaps to facilitate the maintenance of the support portions of such flaps in the compressed relationship.

10. In a combination as set forth in claim 9, the anchor means for each array constituting a member having a pair of spaced arms each extending to the support portions of the flaps in such array at a position spaced in the pack from the other arm and attached to the support portions to facilitate the maintenance of the support portions in the compressed relationship.

11. In combination for use in an abrasive wheel for engaging a workpiece, a plurality of abrasive flaps disposed in an array, each of the abrasive flaps having first and second surfaces disposed in relatively closely spaced and substantially parallel relationship to each other and each defined by a support portion at the inner end of the flap and a working portion at the outer end of the flap and each further defined by a backing member and an adhesive on the first surface of the backing member and by abrasive particles adhered to the adhesive, the abrasive particles being removed from the support portion of each flap the support portions of the flaps in the arrays being retained in a compressed relationship with the abrasive particles on the first surface of each flap at the juncture between the working portion and the support portion of such flap being disposed in abutting relationship with the second surface of the contiguous flap at such juncture position and with the inner ends of the support surfaces of the contiguous flaps being disposed in abutting relationship to define a controlled space between adjacent pairs of the flaps, and additional adhesive disposed in the controlled space between the second surface of the support portion of each flap and the first surface of the support portion of the contiguous flap to retain the support portions of the abrasive flaps in the array in a fixed relationship.

12. In a combination as set forth in claim 11, the controlled space between the second surface of the support portion of each flap and the first surface of the support portion of the contiguous flap having a wedged configuration and the additional adhesive filling the space having the wedge-shaped configuration between the contiguous flaps.

13. In a combination as set forth in claim 12, the working portion of each flap extending outwardly from the support portion of the flap in substantially uniform spacing relative to the contiguous flaps.

14. In a combination as set forth in claim 12, an anchor having first and second opposite ends and disposed at the first end in contiguous relationship with the support portions of the flaps in the array to retain the flaps in the compressed relationship, and means for retaining the second end of the anchor in a relationship to provide for a rotation of the anchor and the flaps in a substantially unitary relationship and for an abrasive action of the abrasive particles on the working portions of the flaps against the workpiece during such rotation.

15. In a combination as set forth in claim 13, an anchor having first and second opposite ends and defined by a pair of spaced legs and by a connecting portion, each of the legs being disposed at the first end in contiguous relationship with the support portions of the flaps in the array to retain the flaps in the compressed relationship, and means for retaining the connecting portion of the anchor in a relationship to provide for a rotation of the anchor and the flaps in a substantially unitary relationship and for an abrasive action of the abrasive particles on the working portions of the flaps against the workpiece during such rotation.

16. In a combination as set forth in claim 15, a rotary member for rotating the array, means in the rotary member for providing for a disposition of the support portions of the abrasive flaps in the array in a fixed relationship with the rotary member during the rotation of the rotary member, and means included in the anchor and disposed in cooperative relationship with the support portions of the abrasive flaps in the array and with the last mentioned means for retaining the support portions of the flaps in a fixed relationship with the rotary member during the rotation of the rotary member.

17. In a combination as set forth in claim 12, means disposed in a co-operative relationship with the support portions of the abrasive flaps in the abrasive array and co-operative with the adhesive for enhancing the retention of the support portions of the abrasive flaps in the compressed relationship and for providing for a movement of the abrasive flaps in the array with the rotary drive member.

18. A method of forming an abrasive array for providing an abrading action against a workpiece, including the following steps:

providing a plurality of abrasive flaps each having a backing member with first and second relatively closely spaced and substantially parallel surfaces and with an adhesive material on the first surface and with abrasive particles adhered to the adhesive material, each of the abrasive flaps having a support portion for holding the flaps in a slightly radially diverging relationship for action against the workpiece, removing the abrasive particles from the support portions of the abrasive flaps while retaining at least a portion of the adhesive on the first surface of the flaps at such support portions, disposing the flaps in a stacked relationship with the first surface of each flap abutting the second surface of the contiguous flap, compressing the support portions of the flaps to provide an abutting relationship between the abrasive particles on each flap, at the juncture between the support portion and the working portion of such flap, and the backing member of the contiguous flap at the juncture between the support portion and the working portion of such flap and to provide an abutting relationship between such flaps at the inner ends of the support portions of the flaps, thereby to provide a controlled spacing between such flaps at the support portions of the flaps, and filling at least a portion of such controlled spacings with an adhesive to retain the flaps in the compressed relationship at the support portions of the array.

19. A method as set forth in claim 18, including the step of:

disposing a member in co-operative relationship with the flaps in the array at the support portions of the flaps to assure that the flaps are retained in the compressed relationship at the support portions.

20. A method as set forth in claim 18, including the steps of:

providing an anchor member having a bulbous retaining portion and having at least one arm extending from the bulbous retaining portion, disposing the anchor member with the arm contiguous to the support portion of at least one of the abrasive flaps in the array, and attaching the arm of the anchor member to the support portions of the abrasive flaps in the array.

21. A method as set forth in claim 18, including the steps of:

providing an anchor member having a connecting portion and having a pair of arms extending from the connecting portion in spaced relationship to each other, disposing the anchor member with the arms contiguous to the support portions of abrasive flaps at spaced positions in the array, and attaching the arms of the anchor member to the support portions of the abrasive flaps in the array.

22. A method as set forth in claim 18, including the steps of:

attaching a retaining member at the support portions of the flaps near the inner ends of the flaps to widen the array at the inner end, providing a rotary member with an annular periphery and with a socket in the annular periphery, the socket having a greater width at a position internal to the annular periphery of the rotary member than at the periphery of the rotary member, and disposing the pack and the retaining member in the socket in the rotary member.

23. A method as set forth in claim 18, including the steps of:

forming the flaps into an annulus with a hollow annular space at the center of the annulus, disposing a mandrel at the center of the hollow annular space, and potting the hollow annular space and the support portions of the flaps with a material to retain the flaps in the annular configuration during the rotation of the flaps.

24. A method of forming an abrasive array for providing an abrasive action against a workpiece, including the steps of:

providing a plurality of abrasive flaps each including a backing member having first and second surfaces and each including adhesive material on the first surface and abrasive particles adhered to the adhesive material, removing the abrasive particles from one end of the abrasive flaps, disposing the flaps in a stacked relationship with the second surface of each flap facing the first surface of the contiguous flap and in a compressed relationship, at the ends where the abrasive particles have been removed from the flaps, to providing an abutting relationship at the inner ends of such flaps and an abutting relationship between the abrasive particles on each flap and the second surface of the contiguous flap at the juncture where the abrasive particles remain and the abrasive particles have been removed, thereby to provide a controlled spacing between the flaps, and disposing adhesive in at least a portion of the controlled spacings between the flaps to adhere the flaps in the array to one another.

25. A method as set forth in claim 24, including the step of:

supporting the array of the abrasive flaps on a rotary member to provide for an abrasive action of the flaps on the workpiece when the member is rotated.

26. A method as set forth in claim 25, wherein an anchor is attached to the array, at the inner ends where the abrasive material has been removed from the abrasive flaps in the array, to maintain the flaps in the compressed relationship and to provide for a coupling of the array to the rotary member.

27. A method as set forth in claim 26, including the steps of:

providing the anchor with a pair of arms disposed in spaced relationship to each other and a portion integrating the pair of spaced arms, extending the arms to the array at spaced positions in the array, attaching the arms to the abrasive flaps in the array at the inner ends where the abrasive particles have been removed from the flaps, and coupling the integrating portion of the anchor to the rotary member.

28. A method as set forth in the claim 26, including the steps of:

providing the anchor with an arm and a portion integral with the arm at the inner end of the support portion, attaching the arm to the abrasive flaps in the array at the inner ends where the abrasive particles have been removed from the flaps, and coupling the integral portion of the anchor to the rotary member.

29. A method as set forth in claim 24, including the steps of:

the flaps being disposed in an annulus having a hollow annular space at the center, disposing a mandrel at the center of the hollow annular space, and potting the hollow annular space with the adhesive.

30. A method as set forth in claim 24 wherein the adhesive is disposed in only a portion of the controlled spacings between the flaps in the radial direction.

31. A method as set forth in claim 24 wherein the flaps are provided with grooves at their sides in the support portions and wherein strings are disposed in the grooves and are tightened to compress the flaps.

32. A method as set forth in claim 31 wherein the adhesive is disposed only in the portions of the controlled spacings radially below the grooves and wherein support members with flanges are provided and wherein the flanges are disposed in the grooves and the support members are retained against the flaps.

33. A method as set forth in claim 24, wherein the controlled space between each contiguous pair of flaps is wedge-shaped and wherein the adhesive inserted in the wedge-shaped space between each contiguous pair of flaps is compatible with the adhesive remaining on the flaps after the removal of the abrasive particles from such flaps.

34. In a combination as set forth in claim 11, at least a portion of the adhesive being retained on the support surface of each flap.

35. A method as set forth in claim 24, at least a portion of the adhesive on the one end of each flap being retained on such one end during the removal of the abrasive particles from such one end of such flap.

36. In combination for use in a pack for engaging a workpiece, a plurality of abrasive flaps each having first and second parallel surfaces and including a backing member and abrasive particles on the first surface of the backing member, each of the abrasive flaps having a working portion at the outer end of such flap and a support portion at the inner end of such flap, the flaps having no abrasive particles in all of the support portions of the flaps but retaining the abrasive particles in the working portions of the flaps, the abrasive flaps having a compressed relationship with respect to one another at intermediate positions on the support portions of the flaps in the direction between the inner and outer ends of the flaps, and means for supporting the flaps in the compressed relationship at only the support portions of the flaps, the disposition of the abrasive particles only on the working portions of the flaps providing for a progressive spacing between the flaps in the working portions of the flaps with progressive distances from the inner ends of the flaps.

37. In a combination as set forth in claim 36 wherein the support means are constructed to provide for a radial disposition of the support portions of the flaps in the compressed relationship and a substantially uniform separation between the flaps at the outer ends of the working portions of the flaps.

38. In combination for use in an abrasive wheel for engaging a workpiece, a plurality of abrasive flaps disposed in an array, each of the abrasive flaps having first and second surfaces disposed in relatively closely spaced and substantially parallel relationship to each other and each defining by a support portion at the inner end of the flap and a working portion at the outer end of the flap and each further defined by a backing member and an adhesive on the first surface of the backing member and by abrasive particles adhered to the adhesive, the abrasive particles being removed from the support portion of each flap, the support portions of the flaps in the array being retained in a compressed relationship and being disposed in abutting relationship with the second surface of the contiguous flap at the juncture between the support portion and the working portion of each flap to define a controlled space between adjacent pairs of the flaps in the working portions of the flaps, and means for retaining the support portions of the abrasive flaps in the array in the compressed relationship.

39. In a combination as set forth in claim 38, the working portion of each flap extending outwardly from the support portion of the flap in a substantially uniform spacing relative to the contiguous flaps.

40. In a combination as set forth in claim 38, the retaining means including an anchor having first and second opposite ends and disposed at the first end in contiguous relationship with the support portions of the flaps in the array to retain the flaps in the compressed relationship, and the retaining means further including means for holding the second end of the anchor in a relationship to provide for a rotation of the anchor and the flaps in a substantially unitary relationship and for an abrasive action of the abrasive particles on the working portions of the flaps against the workpiece during such rotation.

41. In a combination as set forth in claim 39, the retaining mans including an anchor having first and second opposite ends and defined by a pair of spaced legs and by a connecting portions, each of the legs being disposed at the first end in contiguous relationship with the support portions of the flaps in the array to retain the flaps in the compressed relationship, and the retaining means further including means for holding the connecting portion of the anchor in a relationship to provide for a rotation of the anchor and the flaps in a substantially unitary relationship and for an abrasive action of the abrasive particles on the working portions of the flaps against the workpiece during such rotation.

42. In a combination as set forth in claim 40, a rotary member for rotating the array, means in the rotary member for providing for a disposition of the support portions of the abrasive flaps in the array in a fixed relationship with the rotary member during the rotation of the rotary member, and means included in the retaining means and disposed in co-operative relationship with the support portions of the abrasive flaps in the array with the rotary member for retaining the support portions of the flaps in a fixed relationship with the rotary member during the rotation of the rotary member.

43. A method of forming an abrasive array for providing an abrading action against a workpiece, including the following steps:

providing a plurality of abrasive flaps each having a backing member with first and second relatively closely spaced and substantially parallel surfaces and with an adhesive material on the first surface and with abrasive particles adhered to the adhesive material, each of the abrasive flaps having a support portion for holding the flaps in a slightly radially diverging relationship for action against the workpiece, removing the abrasive particles from the support portions of the abrasive flaps while retaining at least a portion of the adhesive on the first surface of the flaps at such support portions, disposing the flaps in a stacked relationship with the first surface of each flap abutting the second surface of the contiguous flap, compressing the support portions of the flaps to provide an abutting relationship between the abrasive particles on each flap, at the juncture between the support portion and the working portion of such flap, and the backing member of the contiguous flap, at the juncture between the support portion and the working portion of such flap, and to provide an abutting relationship between such flaps at the inner ends of the support portions of the flaps, thereby to provide a controlled spacing between such flaps at the support portions of flaps, and retaining the flaps in the compressed relationship at the support portions of the array.

44. A method as set forth in claim 43, wherein the step of retaining the flaps in the compressed relationship includes the step of:

disposing a member in co-operative relationship with the flaps in the array at the support portions of the flaps to assure that the flaps are retained in the compressed relationship at the support portions.

45. A method as set forth in claim 43, wherein the step of retaining the flaps in the compressed relationship includes the steps of:

providing an anchor member having a bulbous retaining portion and having at least one arm extending from the bulbous retaining portion, disposing the anchor member with the arm contiguous to the support portions of the abrasive flaps in the array, and attaching the arm of the anchor member to the support portions of the abrasive flaps in the array.

46. A method as set forth in claim 43, wherein the step or retaining the flaps in the compressed relationship includes the steps of:

providing an anchor member having a connecting portion and having a pair of arms extending from the connecting portion in spaced relationship to each other, disposing the anchor member with the arms contiguous to the support portions of the abrasive flaps at spaced positions in the array, and attaching the arms of the anchor member to the support portions of the abrasive flaps in the array.

47. A method as set forth in claim 43, wherein the steps of retaining the flaps in the compressed relationship includes the steps of:

attaching a retaining member at the support portions of the flaps near the inner ends of the flaps to widen the array at the inner end, providing a rotary member with an annular periphery and with a socket in the annular periphery, the socket having a greater width at a position internal to the annular periphery of the rotary member than at the periphery of the rotary member, and disposing the pack and the retaining member in the socket in the rotary member.

48. A method as set forth in claim 43, wherein the steps of retaining the flaps in the compressed relationship includes the steps of:

forming the flaps into an annular with a hollow annular space at the center of the annulus, disposing a mandrel at the center of the hollow annular space, and potting the hollow annular space and the support portions of the flaps with a material to retain the flaps in the annular configuration during the rotation of the flaps.

49. A method of forming an abrasive array for providing an abrasive action a workpiece, including the steps of:

providing a plurality of abrasive flaps each including a backing member having first and second surfaces and each including adhesive material on the first surface and abrasive particles adhered to the adhesive material and each including a support portion and a working portion, removing the abrasive particles from the support portions of the abrasive flaps, disposing the flaps in a stocked relationship with the second surface of each flap facing the first surface of the contiguous flap and with the support portions of the flaps in a compressed relationship, providing an abutting relationship of the flaps at the support portions of such flaps and an abutting relationship between the abrasive particles on each flap and the second surface of contiguous flap at the juncture where the abrasive particles remain and the abrasive particles have been removed, thereby to provide a controlled spacing between the flaps, and retaining the flaps in the compressed relationship.

50. A method as set forth in claim 49, including the step of:

supporting the array of the abrasive flaps on a rotary member to provide for an abrasive action of the flaps on the workpiece when the member is rotated.

51. A method as set forth in claim 50, wherein an anchor is attached to the array, at the support portions of the flaps to maintain the flaps in the compressed relationship and to provide for a coupling of the array to the rotary member.

52. A method as set forth in claim 50, including the steps of:

the flaps being disposed in an annulus having a hollow annular space at the center, disposing a mandrel at the center of the hollow annular space, and potting the hollow annular space with the adhesive.

* * * * *